US005481836A

United States Patent [19]

Miller et al.

[11] Patent Number: 5,481,836

[45] Date of Patent: Jan. 9, 1996

[54] WALL SUPPORT SYSTEM

[76] Inventors: Mark M. Miller, 2374 Dempsey Ave. NW., Buffalo, Minn. 55313; Michael M. Miller, 680 Virginia Shores, Excelsior, Minn. 55331

[21] Appl. No.: 228,395

[22] Filed: Apr. 15, 1994

[51] Int. Cl.[6] ..... E04G 21/26

[52] U.S. Cl. ..... 52/127.2; 52/149

[58] Field of Search ..... 52/127.2, DIG. 1, 52/127.1, 149; 248/121

[56] References Cited

U.S. PATENT DOCUMENTS

| | | | |
|---|---|---|---|
| 1,616,426 | 2/1927 | Isaacson | 52/127.2 X |
| 2,514,397 | 7/1950 | Joyce | 52/127.2 X |
| 3,817,006 | 6/1974 | Williams | 52/127.2 X |
| 4,000,592 | 1/1977 | Kelly . | |
| 4,068,427 | 1/1978 | Camardo | 52/127.2 X |
| 4,070,833 | 1/1978 | Hancock . | |
| 4,986,043 | 1/1991 | Love | 52/127.2 |
| 5,322,404 | 6/1994 | Keller | 52/DIG. 1 X |

FOREIGN PATENT DOCUMENTS

| | | |
|---|---|---|
| 0942732 | 3/1974 | Canada . |
| 1156446 | 5/1958 | France . |
| 2233472 | 10/1975 | France . |
| 0529964 | 6/1955 | Italy . |
| 0699149 | 11/1979 | U.S.S.R. . |
| 018420 | 8/1994 | WIPO . |

*Primary Examiner*—Carl D. Friedman
*Assistant Examiner*—Yvonne Horton-Richardson
*Attorney, Agent, or Firm*—Hugh D. Jaeger

[57] ABSTRACT

A wall support system for supporting a wall such as a masonry wall with respect to the ground. The wall support system includes a base with a 4×4 fitting and a pivotal chain lever, a wall support with a chain loop, a cement loop and a chain with a hook. The chain extends from the pivotal chain lever on the base through the cement loop, through the chain loop on the wall support and hooked to a overlapped link to bring the system into tension where the pivotal chain lever tensions the chain.

18 Claims, 5 Drawing Sheets

WALL SUPPORT SYSTEM

BACKGROUND OF THE INVENTION

1. Field of the Invention

The present invention pertains to a wall support system for construction, and more particularly, pertains to a wall support system utilizing a chain between a base member, a cement loop, and a wall support member, and a 4×4 extending between the base and wall support.

2. Description of the Prior Art

Prior art efforts in supporting walls under construction have included a particular amount of framing lumber which has now become expensive or metal tubes usually including a screw on one or both ends. Neither have been practical.

Framing lumber because of the spotted owl has become expensive, and also time consuming to frame a support structure. Usually the framing lumber after use is sometimes impractical for reuse, or if the lumber is reusable, it takes time to clean up the lumber such as pulling out nails and disassembly, etc.

Piping for supporting a wall usually requires a pipe with screw threads on either end or both ends, some type of support structure which is not always practical because the screw threads become coated with concrete such as from the mortar. Also, the piping still requires additional backbracing with framing lumber and also requires cleanup at the end during disassembly, especially about the screw threads which can be difficult.

The present invention overcomes the disadvantage of prior art by providing a wall support system which is easily utilized and requires minimal framing lumber only being a 4×4 which can be easily reused.

SUMMARY OF THE INVENTION

The general purpose of the present invention is a wall support system for supporting a wall such as a masonry wall or a concrete block wall, and requires minimal framing lumber such as only a single 4×4. The wall support system is easily utilizable with minimal effort and minimal time, and can be rapidly positioned in a manner of a few minutes. The wall support system includes a chain loop which is cemented below the wall such as in the footing, and is usually formed from reinforcing bar.

According to one embodiment of the present invention, there is provided a wall support system for supporting a wall with respect to the ground which includes a base with a 4×4 fitting and a pivotal chain lever, a wall support including a chain loop, a cement loop for the chain at the base of the masonry wall, and a chain with a hook extending between the pivotal chain lever of the base, through the cement loop, through a chain loop on the wall support, and hooked to an overlapping link when a 4×4 is placed in position between the 4×4 fittings. The pivotal chain lever tightens the chain between the base, the wall support and with respect to the cement loop, and tensions the system for support of a wall.

One significant aspect and feature of the present invention is a wall support system which is easily utilizable in the field within a matter of minutes, and only requires a 4×4 for use in addition to a cement loop for a chain secured into the footing, foundation or the base of the wall.

Another significant aspect and feature of the present invention is a wall support system which tensions about itself.

An additional significant aspect and feature of the present invention is a wall support system which is easily storable and transportable.

Still another significant aspect and feature of the present invention is a wall support system which utilizes a 4×4 wooden post.

Having thus described embodiments of the present invention, it is the principal object hereof to provide a wall support system for supporting walls such as a masonry wall or a concrete block wall.

One object of the present invention is a wall support system which is light weight and easy to install.

Another object of the present invention is a wall support system which supports a wall under construction, especially preventing a collapse or cave in of the wall.

A further object of the present invention is a wall support which can be installed by a single individual.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
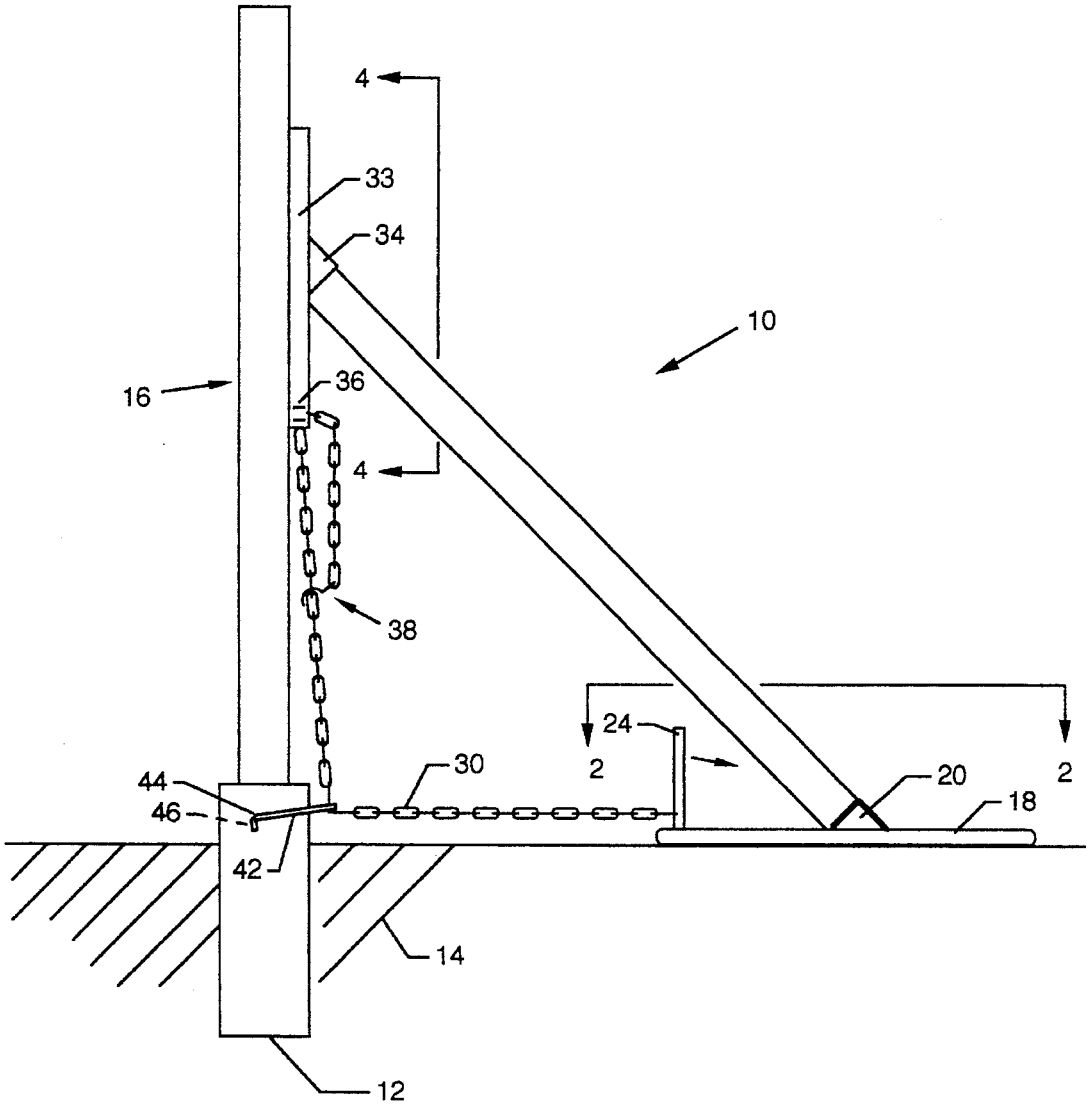
FIG. 1 illustrates a plan view of the wall support system.
Figure 3:
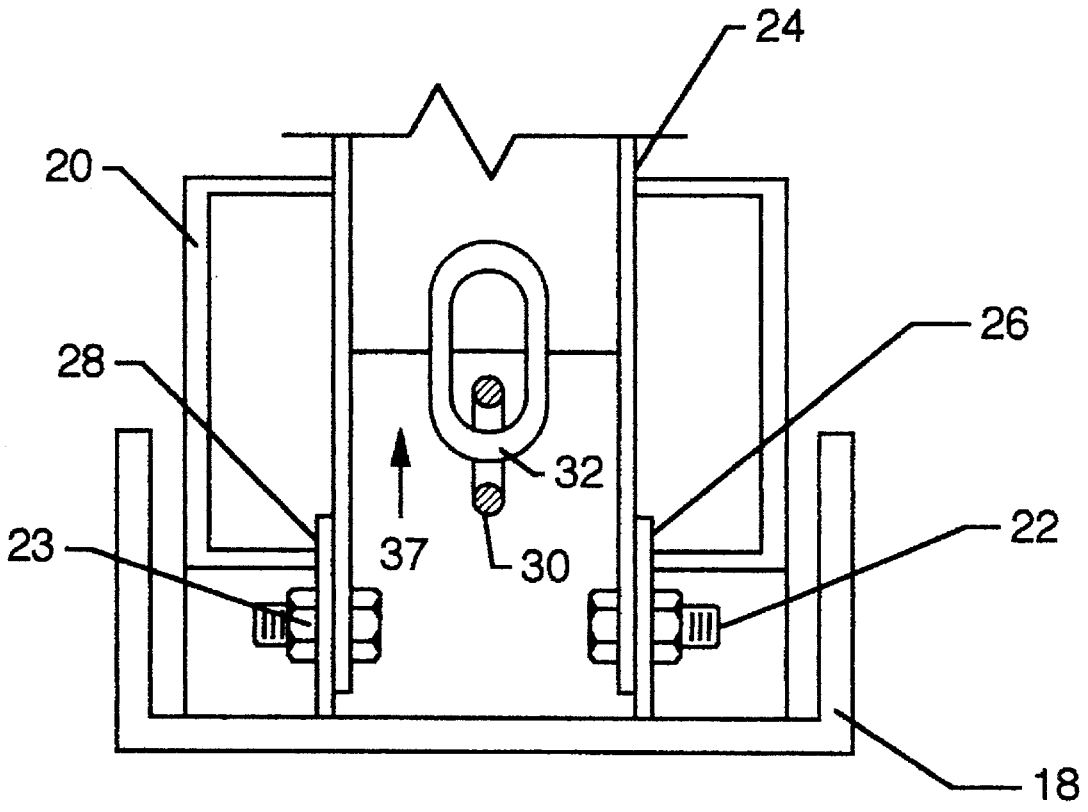
FIG. 3 illustrates a view taken along line 3—3 of FIG. 1.
Figure 4:
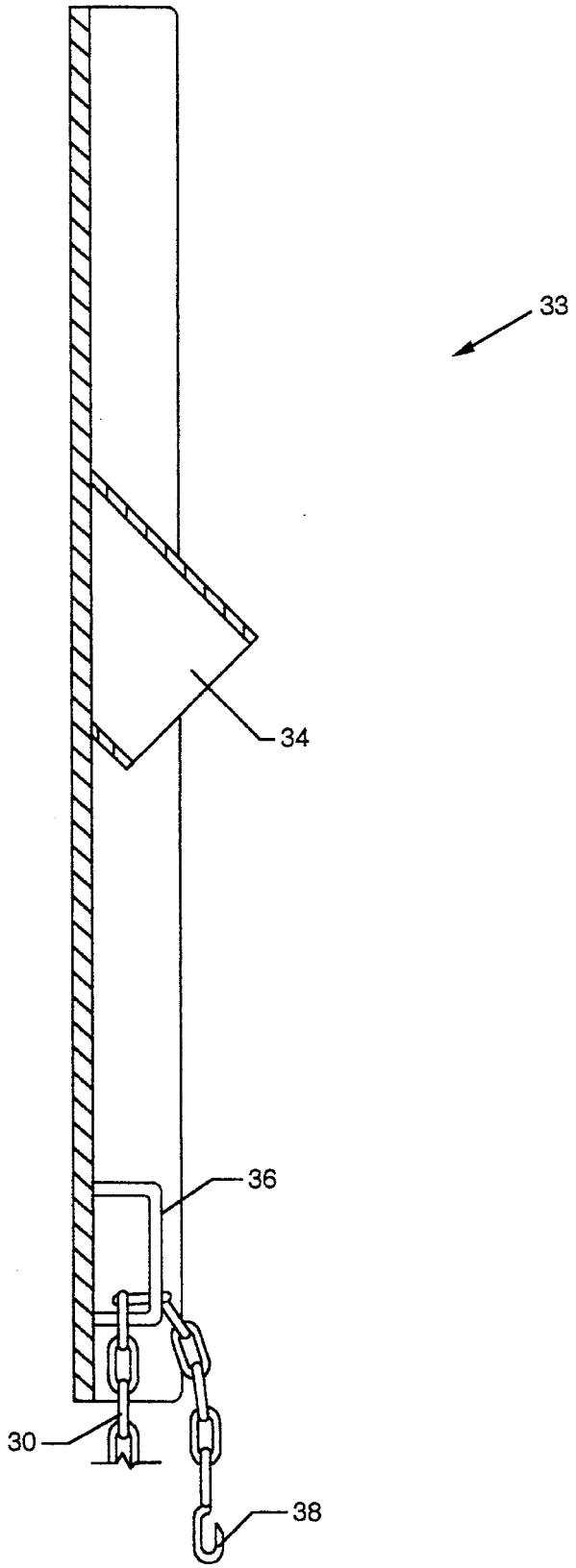
FIG. 4 illustrates a cross sectional view of the wall support.
Figure 5:
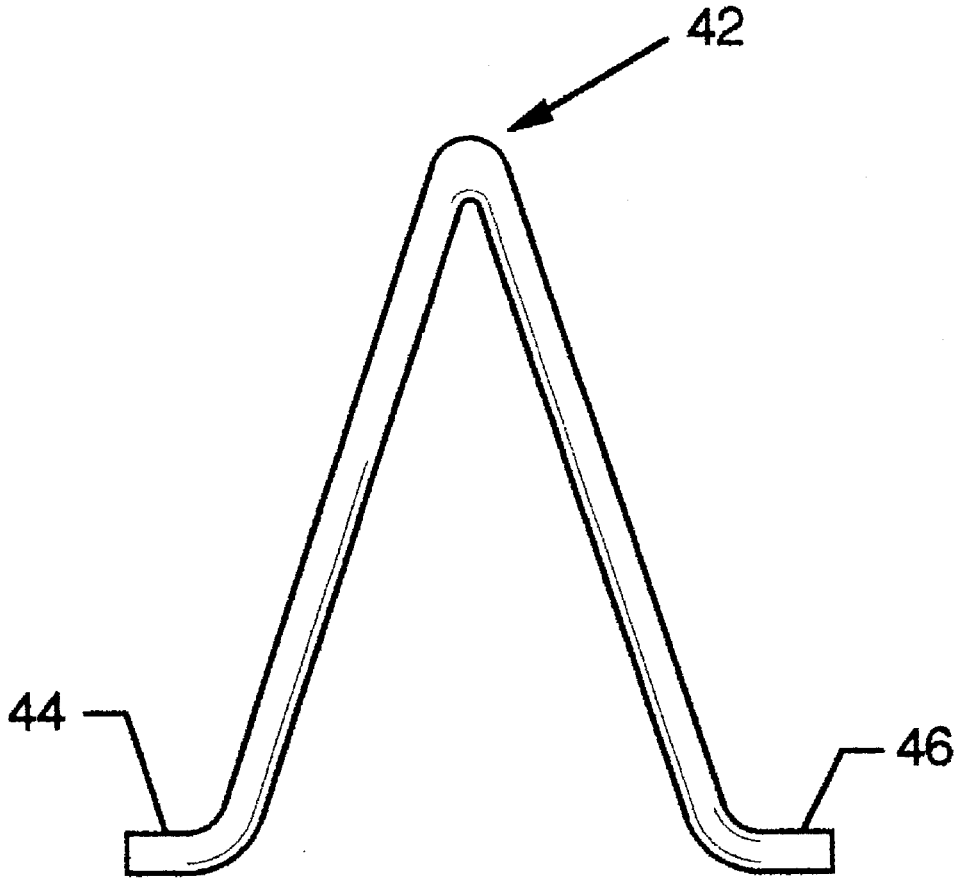
FIG. 5 illustrates a view of the current loop for the chain.

FIG. 1 illustrates a front view of a wall support system 10 including a footing 12 in the ground 14 for supporting a masonry wall 16. A base 18 of 2×6 steel channel includes square tubing 20 for accommodation of a 4×4 wood lumber welded to the base 18 at a suitable angle. A pivotal chain lever 24 of 1×2 steel channel rotates about pivots 22 and 23 which engage tabs 26 and 28 welded to the base 18 as illustrated in FIG. 3. A chain 30 secures to the lever 24 such as by a loop chain link 32 welded to the lower portion of the lever 24 or any other suitable securing means such as illustrated in FIG. 3. A wall support 33 includes square tubing 34 welded to the wall support 33 and a square chain loop 36 made from 2×3 tubing welded to the support 33 as illustrated in FIG. 4. The chain 30 includes a hook 38 which hooks back upon itself at an appropriate chain link. The chain 30 extends through a cement loop 42 which is formed from reinforcing bar and is about 12 inches on each side, and bent at an angle of about 30°–60°. The loop 42 can also include toes 44 and 46 to further engage in the footing. The angle of the 4×4 fittings is preferably 45° although any suitable angle can be utilized. Pivots 22 and 23 can be nut and bolt assemblies.

Figure 2:
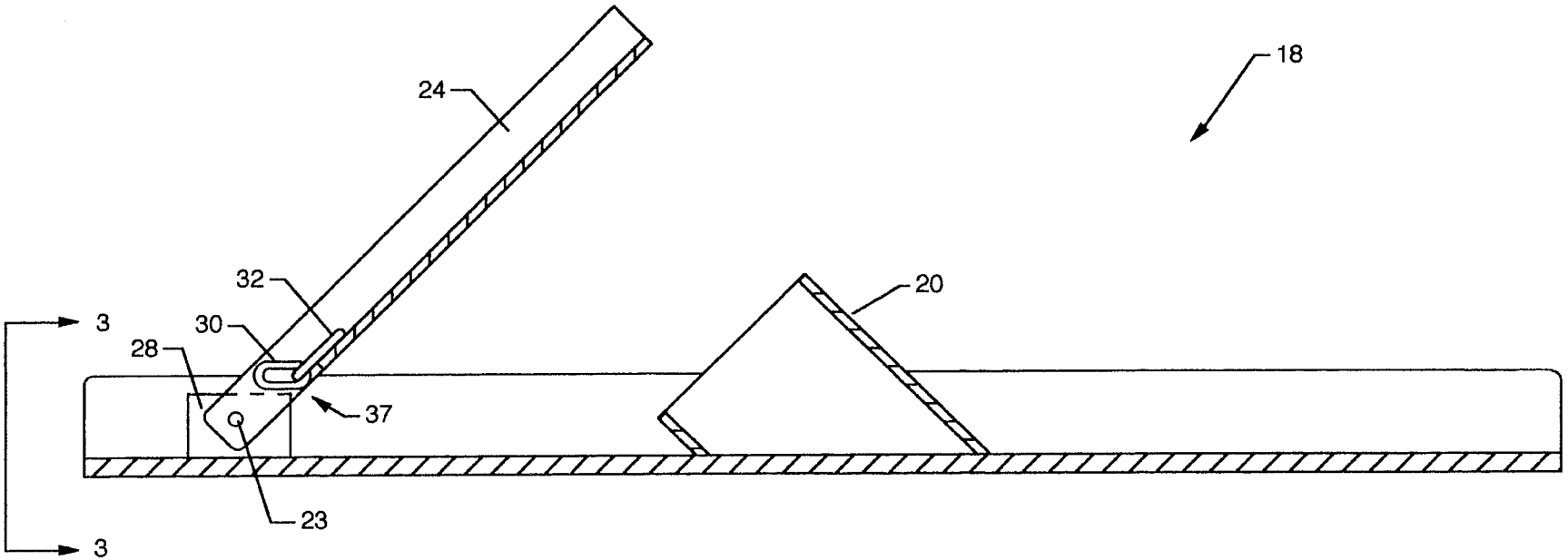
FIG. 2 illustrates a cross sectional view of a base.

FIG. 2 illustrates a cross sectional view along the center of the base 18 along line 2—2 of FIG. 1 where all numerals correspond to those elements previously described. Illustrated in particular is the pivotal chain lever 24 upon which a chain link 32 is welded. A cutout area 37 in the pivotal chain lever 24 allows room for attachment of the chain 30 to the chain link 32.

FIG. 3 illustrates a view taken along line 3—3 of FIG. 2 where all numerals correspond to those elements previously described. Illustrated in particular is the lower end of the chain lever 24 which is pivotally attached to the tabs 26 and 28 on the base 18.

FIG. 4 illustrates a cross sectional view along line 4—4 of FIG, 1 of the wall support 30 where all numerals correspond to those elements previously described.

MODE OF OPERATION

A 4×4 timber or lumber is positioned between the square tubing members 20 and 34, then with the pivotal chain lever 24 disengaged, the chain 30 is led through the chain loop 36 and is overlapped and hooked, and then the chain is tensioned. The pivotal chain lever 24 is engaged for tightening the chain 30 between the base and the wall support members 18 and 33 with respect to the cement loop 42 causing the linkages of the 4×4's and the chain 30 to equalize under tension for supporting the wall 16 with respect to the ground. The 4×4 can be wood, formed of metal lumber, or two 2×4's nailed together. A wood 4×4 is the most practical. The wall can be a masonry wall, concrete block wall, or a poured wall.

The sizes of the members can be changed. The 4×4 angled fitting can be a three sided angled member welded to the base and to the wall support metal tubes could be substituted for the brace. The size of the chain can vary. The end chain loop can be welded or bolted to the lever which can also be formed like a handle.

Various modifications can be made to the present invention without departing from the apparent scope hereof.

The cement loop can be a eye bolt or other like loop structure.

We claim:

1. A wall support system for a wall in combination with a footing comprising:

a. a base including 1) a welded angled means for receiving a 4×4 at one end of said base; 2) opposing welded tabs with center holes at the other end of said base; 3) a handle mounted between said tabs with nut and bolt assemblies; and 4) a chain with a hook welded to a lower end of said handle;

b. a wall support including 1) a welded angle means for receiving a 4×4 in a midportion of said wall support, and 2) a square loop tube welded to said wall support for passing through a chain;

c. a cement loop means for attachment into a footing; and, d. a 4×4 member engaged between said welded angle means whereby said chain is passed through said cement loop means, then through said square loop tube, said hook is hooked over a loop, and then said handle is rotated to tighten said chain thereby engaging said system between a wall, a ground, and about said cement loop means.

2. The system of claim 1 wherein said base is 2×6 steel channel.

3. The system of claim 1 wherein said welded angle 4×4 means is a steel tube.

4. The system of claim 1 wherein said handle is 1×2 steel channel.

5. The system of claim 1 wherein said chain is 1×1¾ links.

6. The system of claim 1 wherein said hook is of a depth of 1¼.

7. The system of claim 1 wherein said wall support is 2×6 steel channel.

8. The system of claim 1 wherein said square loop tube is a 2×3 square tube.

9. The system of claim 1 wherein said cement loop is a 36" length of ½" rebar bent into a "V".

10. A wall support system for a wall in combination with a footing comprising:

a. a base including 1) a welded angled means for receiving a rectangular member at one end of said base; 2) opposing welded tabs with center holes at the other end of said base; 3) a handle mounted between said tabs with nut and bolt assemblies; and 4) a chain with a hook welded to a lower end of said handle;

b. a wall support including 1) a welded angle means for receiving a rectangular member in a midportion of said wall support, and 2) a square loop tube welded to said wall support for passing through a chain;

c. a cement loop means for attachment into a footing; and, d. a rectangular member engaged between said welded angle means whereby said chain is passed through said cement loop means, then through said square loop tube, said hook is hooked over a loop, and then said handle is rotated to tighten said chain, thereby engaging said system between a wall, a ground, and about said cement loop means.

11. The system of claim 10 wherein said base is 2×6 steel channel.

12. The system of claim 10 wherein said welded angle 4×4 means is 4×4 steel tube.

13. The system of claim 10 wherein said handle is 1×2 steel channel.

14. The system of claim 10 wherein said chain is 1×1¾ links.

15. The system of claim 10 wherein said hook is of a depth of 1¼.

16. The system of claim 10 wherein said wall support is 2×6 steel channel.

17. The system of claim 10 wherein said square loop tube is a 2×3 square tube.

18. A process for supporting a wall comprising the steps of:

a. placing a base on a ground, said base including 1) welded angled 4×4 means for receiving a 4×4 at one end of said base; 2) opposing welded tabs with center holes at the other end of said base; 3) a handle mounted between said tabs with nut and bolt assemblies; and 4) a chain with a hook welded to a lower end of said handle;

b. placing a wall support against a wall, said wall support including 1) a welded angle means for receiving a 4×4 in a midportion of said wall support, and 2) a square loop tube welded to said wall support for passing through a chain;

c. placing a cement loop in a ground structure; and, d. using a 4×4 member engaged between said welded angle means whereby said chain is passed through said cement loop means, then through said square loop tube, said hook is hooked over a loop, and then said handle is rotated to tighten said chain thereby engaging said system between a wall, a ground, and about said cement loop means.

* * * * *